US012371859B2

(12) United States Patent
Grimwade et al.

(10) Patent No.: US 12,371,859 B2
(45) Date of Patent: Jul. 29, 2025

(54) RAIL CLAMP CONNECTOR

(71) Applicant: PANDROL (VORTOK) LTD, Addlestone (GB)

(72) Inventors: David James Grimwade, Plymouth (GB); Neil Algar, Waikanae Beach (GB); Craig Mulvay, Waikanae Beach (NZ)

(73) Assignee: PANDROL (VORTOK) LTD, Addlestone (GB)

( * ) Notice: Subject to any disclaimer, the term of this patent is extended or adjusted under 35 U.S.C. 154(b) by 785 days.

(21) Appl. No.: 17/608,364

(22) PCT Filed: Apr. 28, 2020

(86) PCT No.: PCT/EP2020/061796
§ 371 (c)(1),
(2) Date: Nov. 2, 2021

(87) PCT Pub. No.: WO2020/225037
PCT Pub. Date: Nov. 12, 2020

(65) Prior Publication Data

US 2022/0235520 A1 Jul. 28, 2022

(30) Foreign Application Priority Data

May 3, 2019 (GB) ..... 1906254

(51) Int. Cl.
*E01B 9/60* (2006.01)
*B61L 1/02* (2006.01)

(52) U.S. Cl.
CPC . *E01B 9/60* (2013.01); *B61L 1/02* (2013.01)

(58) Field of Classification Search
CPC ..... E01B 9/60; B61L 1/02
See application file for complete search history.

(56) References Cited

U.S. PATENT DOCUMENTS

| | | | | | |
|---|---|---|---|---|---|
| 1,468,532 | A * | 9/1923 | Korba | E01B 5/16 | 238/277 |
| 4,753,403 | A * | 6/1988 | Chew | B61L 1/00 | 246/473 R |
| 4,799,444 | A * | 1/1989 | Lisowski | F16B 2/06 | 114/221 R |
| 4,824,015 | A * | 4/1989 | Farrell | E01B 9/60 | 238/349 |

FOREIGN PATENT DOCUMENTS

| | | | |
|---|---|---|---|
| AU | 2023201195 B1 | * | 11/2023 |
| BE | 1014197 A3 | | 6/2003 |
| CN | 221589089 U | * | 8/2024 |

(Continued)

*Primary Examiner* — Jason C Smith
(74) *Attorney, Agent, or Firm* — Perry + Currier

(57) ABSTRACT

According to the disclosure, there is provided a rail clamp connector for connecting a rail clamp to a beam. The rail clamp connector may be for connecting a rail clamp to a beam and the rail clamp connector may comprise a first part connectable to the beam. The rail clamp connector may further comprise a second part, pivotally (pivotably) connected to the first part, connectable to the rail clamp. The rail clamp connector may further comprise a vibration damping device to reduce the transmittal of vibration from the second part to the first part.

12 Claims, 4 Drawing Sheets

(56) References Cited

FOREIGN PATENT DOCUMENTS

| | | | | | |
|---|---|---|---|---|---|
| DE | 20300537 | U1 | * | 6/2003 | ..... E01B 26/005 |
| EP | 2191069 | T3 | * | 9/2008 | |
| EP | 3318444 | A1 | * | 5/2018 | |
| EP | 3963136 | B1 | * | 3/2024 | ..... B61L 1/02 |
| GB | 2347456 | A | | 9/2000 | |
| GB | 2431956 | A | | 5/2007 | |
| GB | 2471277 | A | | 12/2010 | |
| GB | 2583722 | A | * | 11/2020 | ..... B61L 1/02 |
| KR | 20120123763 | A | | 11/2012 | |
| KR | 20140143246 | A | | 12/2014 | |
| WO | WO-03033327 | A1 | * | 4/2003 | ..... B61L 29/02 |

* cited by examiner

RAIL CLAMP CONNECTOR

FIELD

The disclosure relates to a rail clamp connector, for connecting a rail clamp to a beam for mounting equipment to a rail track. The disclosure further relates to a rail clamp assembly.

BACKGROUND

It is possible to mount equipment such as sensors, transponders, magnets or balises directly to a rail foundation. Mounting equipment to the rail foundation directly may be time consuming and may lead to railway lines needing to be closed for long periods of time. Equipment may be positioned between the rails of a railway line and may be mounted directly to the rails.

STATEMENTS

According to an embodiment, there is provided a rail clamp connector. The rail clamp connector may be for connecting a rail clamp to a beam and the rail clamp connector may comprise a first part connectable to the beam. The rail clamp connector may further comprise a second part, pivotally (pivotably) connected to the first part, connectable to the rail clamp. The rail clamp connector may further comprise a vibration damping device to reduce the transmittal of vibration from the second part to the first part. According to the embodiment, an improved rail clamp connector for an equipment mounting assembly may be provided, which allows for quick installation and increased life of the assembly and equipment.

The rail clamp connector may provide a beneficial connection between the rail clamp and the beam, which allows for articulation such that the rail clamp may be passed under the rail to allow for easier and faster installation. Such articulation also provides improved manoeuvrability when attaching the rail clamp, avoiding the need, in some instances, for the rail to be moved to install the rail clamp or equipment mounting assembly. Further, the articulation may allow the rail clamp to move with a rail, to which it is attached, when the rail tilts or moves due for example to the passing of a train. The vibration damper may assist in providing reduced translation of the movement, due to the passing of the train, from the second part to the first part and, indirectly, from the rail to the equipment mounted on the beam.

In an example, the second part may be pivotally connected to the first part by a clevis joint. A clevis joint may beneficially allow for sufficient relative movement of the first and second part, while providing appropriate support to the beam and any equipment to be mounted on the beam. A clevis joint may further provide suitable relative movement between the first and second part during installation to allow the rail clamp to be mounted to a rail, but may be fixed in place, so as to inhibit relative movement, after installation, as described further below.

In a further example, the vibration damping device may be an elastic member or a resiliently deformable member. The member may for example be made of rubber. Damping may be provided by any suitable material. An elastic or resiliently deformable member may be provided as a mount in the pivotal connection, for example in the clevis joint. In an example, the first and second part may be fixed to the damping device to inhibit movement other than flex provided by the damping device to maintain the damping effect.

In an example, the vibration damping device may reduce the transmittal of vibration from the first part to the second part. While the vibration damping device may reduce the transmission of vibrations from the second part to the first part, the vibration damping device may also reduce vibrations in the opposite direction. Vibration damping may beneficially reduce the vibrations experienced by equipment mounted on the beam, which are created by normal railway use, such as a train passing on the rail over the rail clamp.

In a example, the rail clamp connector may further comprise a fixing device to restrict relative movement of the first part and the second part at the pivotal connection.

According to an embodiment, there is provided a rail clamp assembly or system. The rail clamp assembly may comprise the rail clamp connector as described above. The rail clamp assembly may further comprise an adjustable rail clamp connectable to an underside of a rail. In an example, a rail clamp for attachment around the foot of a rail may be part of a rail clamp assembly. The rail clamp assembly may provide means to connect a beam, on which equipment may be mounted, to a rail.

In an example, the rail clamp may be adjustable in width to be connectable around the underside of rails of differing widths. The rail clamp may for example include fasteners, such as bolts, which may be adjusted so that the rail clamp may pass around the foot of rails having different foot widths. With such an arrangement, only a minimal clearance beneath the rail is required, as the rail clamp may be attached to the rail by passing the fasteners under the rail and attaching the fasteners at either end to respective sides of the rail clamp.

In a further example, the rail clamp assembly may further comprise a beam connectable to the first part. In use, the beam may extend above the underside of the rail. When viewed from the side, the top of the beam may be higher than the underside of the rail. It may be beneficial to reduce how far the rail clamp assembly protrudes beneath the rail. Components such as the beam may have a relatively large cross section, making their positioning relative to the rail a consideration when reducing the dimensions of the assembly below the rail. In this example, the beam may extend away from the rail clamp connector, towards a rail clamp assembly connected to another rail, while only extending partly beneath the foot of the rail or not extending beneath the foot of the rail at all. In an example, a centreline of the beam may be substantially in line with the bottom surface of the rail, when the rail is in a vertical orientation and therefore the bottom surface of the rail horizontal. By positioning the beam in this way, the amount of space required beneath the rail may be reduced.

In an example, the rail clamp may comprise pivotally attachable fasteners to clamp a foot of the rail. The rail clamp may include a portion arranged to extend at least partly over the foot of the rail, so that, when tightened, the portion holds or clamps onto the rail. Such fasteners may for example include nut and bolt-type fasteners where the bolt is able to pivot so as to provide flexibility to accommodate rails of different sizes. Pivotally attachable fasteners may provide a benefit during installation that they can be moved to allow the rail clamp to be manoeuvred into place more easily. Further, pivotally attachable fasteners may allow the rail clamp to fit around rails having a range of different foot heights.

In an example, there is provided a further rail clamp assembly. The rail clamp assembly may comprise a rail clamp connector as described above. The rail clamp assembly may further comprise an adjustable rail clamp connectable to a side of a foot of a rail, wherein the rail is a running rail or a guard rail.

In an example, there is provided a further rail clamp assembly. The rail clamp assembly may comprise a beam, a first rail clamp connector of any preceding claim attached to one end of the beam, a second rail clamp connector of any preceding claim attached to the other end of the beam, a first adjustable rail clamp connected at one side to the first rail clamp connector and at the other side to a side of a foot of a first rail, and a second adjustable rail clamp connected at one side to the second rail clamp connector and at the other side to a side of a foot of a second rail. The first and/or second rails may be a running rail or a guard rail.

BRIEF DESCRIPTION OF DRAWINGS

Examples will now be described, by way of non-limiting examples, with reference to the accompanying drawings, in which.

DETAILED DESCRIPTION

In the present disclosure, there is provided a rail clamp connector which may be used to mount equipment between sleepers on ballasted track, or in between rail fastenings on slab or ballastless track, which equipment is retained in place by clamping to the foot of the rail. A railway rail may include a head, web (middle connecting portion) and foot. In order to attach equipment at a desired location to the rail, there may be provided a rail clamp. Such a clamp may be attachable around the foot of the rail. A rail clamp may then be connected to a beam, such as an equipment mount beam, via a rail clamp connector. The rail clamp connector may be part of the rail clamp or may be separate to the rail clamp. A rail clamp may be provided on each rail of a railway track, with a beam mounted between the two clamps and attached to both clamps by two rail clamp connectors. A rail clamp assembly, which may also be described as an equipment mounting assembly, may for example include the rail clamps, connectors and beam. In an example, a rail clamp may include parts which extend around both sides of the foot of a rail or a part attaching/clamping onto one side of the rail, which may for example be the inner side of the rail, facing the other rail, on a railway track having two rails.

The rail clamp connector may provide a pivotal connection so that the rail clamp may pivot relative to the beam. Providing such a pivotal connection allows the rail clamp assembly to be adjusted during installation to compensate for any rail leaning, so as to provide an appropriate attachment to a leaning rail. Further, providing a pivotal connection with a vibration damping device may allow any equipment mounted to the beam to be held while experiencing less movement resulting from the rail leaning (cant) as the pivot allows the rail and clamp to move while the beam and equipment remain relatively still. The beam may be attached to the rail clamp connector by any suitable means. For example, the beam may be attached to the rail clamp connector by fitting to a yoke end (clevis end). Equipment may be attached to the beam by any suitable means, for example a fastener or clamp. The beam may comprise a length of glass reinforced plastic (GRP). The beam may provide electrical isolation and resilience to shock as well as further vibration damping.

The rail clamp connector may for example be made primarily of stainless steel. GRP and stainless steel may provide a rail clamp assembly that is highly resistant to chemical and biological substances.

Figure 1:
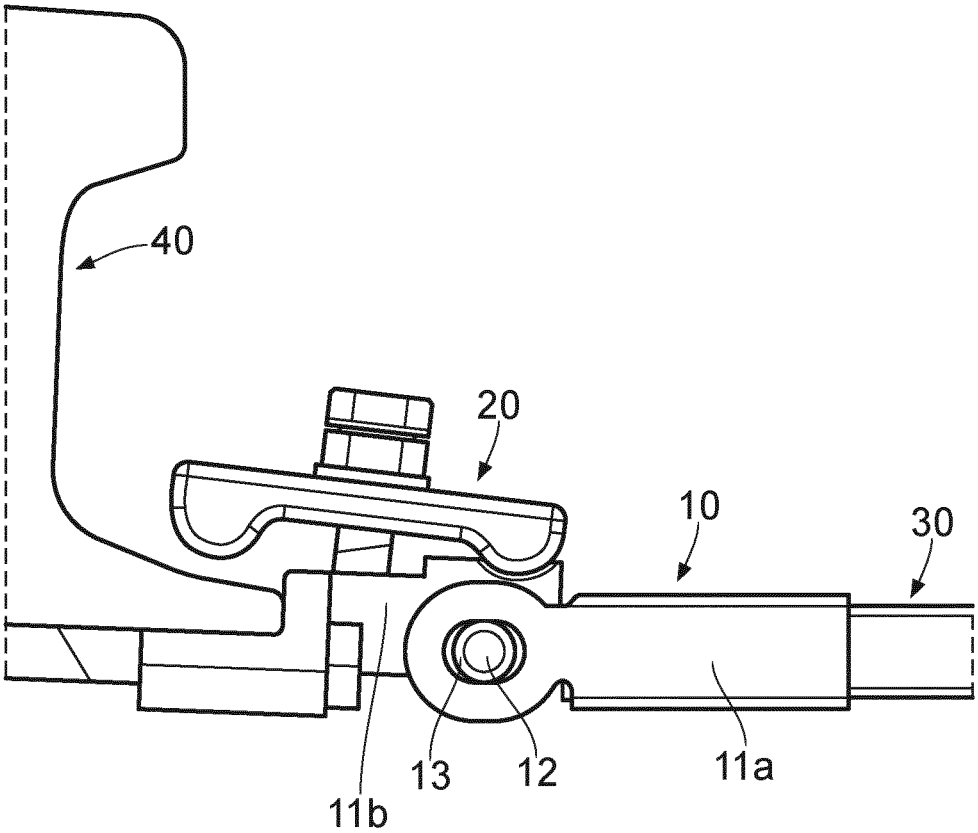
FIG. 1 is a schematic of an example of a rail clamp connector in situ.

In an example, as shown in FIG. 1, there is provided a rail clamp connector 10. The rail clamp connector 10 may connect a rail clamp 20 to a beam 30 and the rail clamp connector 10 may comprise a first part 11*a* connectable to the beam 30. The rail clamp connector 10 may further comprise a second part 11*b*, pivotally connected to the first part 11*a* at a pivotal connection. The second part 11*b* may be connectable to the rail clamp 20. The rail clamp connector 10 may further comprise a vibration damping device 13 to reduce the transmittal of vibration from the second part 11*b* to the first part 11*a*. In an example, the rail clamp connector 10 may further comprise a fixing device (124—shown in FIG. 3) to restrict relative movement of the first part and the second part at the pivotal connection. Such a fixing device may attach to the vibration damping device 13. In an example, the fixing device 124 may comprise a through bolt and locking nut.

The second part 11*b* may be pivotally connected to the first part 11*a* by a clevis joint and the damping device 13 may be an elastic member or a resiliently deformable member. The member may for example preferably be made of rubber.

In an example, the vibration damping device 13 may provide vibration damping to reduce the transmittal of vibration from the first part 11*a* to the second part 11*b*. While the vibration damping device 13 may reduce the transmission of vibrations from the second part 11*b* to the first part 11*a*, the vibration damping device 13 may also reduce vibrations in the opposite direction. Vibration damping may beneficially reduce the vibrations experienced by equipment mounted on the beam, which are created by normal railway use, such as a train passing on the rail over the rail clamp. In an example, the pivotal connection, which may be a clevis joint including a pin 12 surrounded by rubber bushes as the damping device 13, isolating the male and female parts. Rubber bushes 13 may improve shock and vibration resistance to whatever equipment may be mounted on the beam, from the shock and vibration input by traffic running on the rail.

Figure 2:
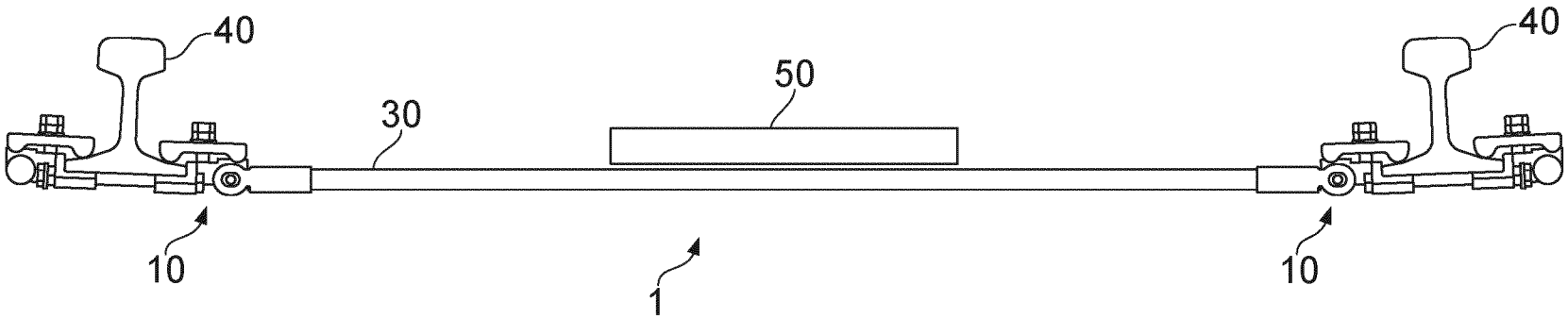
FIG. 2 is a schematic of an example of a rail clamp assembly.

In an example, as shown in FIG. 2, there is provided a rail clamp assembly or system 1. The rail clamp assembly 1 may comprise the rail clamp connector 10 as described above. The rail clamp assembly 1 may further comprise an adjustable rail clamp 20 connectable to an underside of a rail 40. In an example, a rail clamp 20 for attachment around the foot of a rail 40 may be part of the rail clamp assembly 1. The rail clamp assembly 1 may provide connection means to connect a beam 30, on which equipment 50 may be mounted, to a rail 40.

The rail clamp assembly 1 may provide means for fixing or mounting equipment 50, such as sensors, between rails 40 of a railway line. The rail clamp assembly 1 may for example include two rail clamps 20 for attachment to two parallel rails 40. The rail clamps 20 may each be connected by a rail clamp connector 10 to either side of a beam 30. The beam 30 may extend from one rail clamp connector 10 to the other, so that the rail clamp assembly 1 may hold the beam 30 in place, extending between the rails 40. Therefore, equipment 50 may be mounted in the space between the rails 40, on the beam 30. Providing a rail clamp connector 10 at either side of the beam 30, between the beam 30 and each rail 40, may beneficially make installation easier as the assembly 1 may be more easily manoeuvred into place and/or reduce movement of the equipment 50 when mounted to the beam 30. This arrangement may allow for installation on leaning rails and allow the rails 40 to lean without the need for the beam 30 to move or flex. The rail clamp assembly 1 may accommodate typical rail incline/lean/cant, such as 1:20, 1:30, 1:40 or vertical rail, but the rail clamp connector 10 may allow for total adjustability for cant.

In an example, the rail clamp 20 may be adjustable in width to be connectable around the underside of rails 40 of differing widths. The rail clamp 20 may for example include fasteners 121, 122, such as bolts, which may be adjusted so that the rail clamp 20 may pass around the foot of rails 40 having different foot widths. In an example, the rail clamp may be connectable to one side of a foot of a rail only.

In a further example, the rail clamp assembly 1 may further comprise a beam 30 connectable to the first part 11*a*. In use, the beam 30 may extend above the underside of the rail 40. It may be beneficial to reduce how far the rail clamp assembly 1 protrudes beneath the rail 40. Components such as the beam 30 may have a relatively large cross section, making their positioning relative to the rail 40 a consideration when reducing the dimensions of the assembly 1 below the rail 40. In this example, the beam 30 may extend away from the rail clamp connector 10 while only extending partly beneath the foot of the rail 40 or not extending beneath the foot of the rail 40 at all. In an example, a centreline of the beam 30 may be substantially in line with the bottom surface of the rail 40, when the rail 40 is in a vertical orientation and therefore the bottom surface of the rail 40 horizontal.

Figure 3:
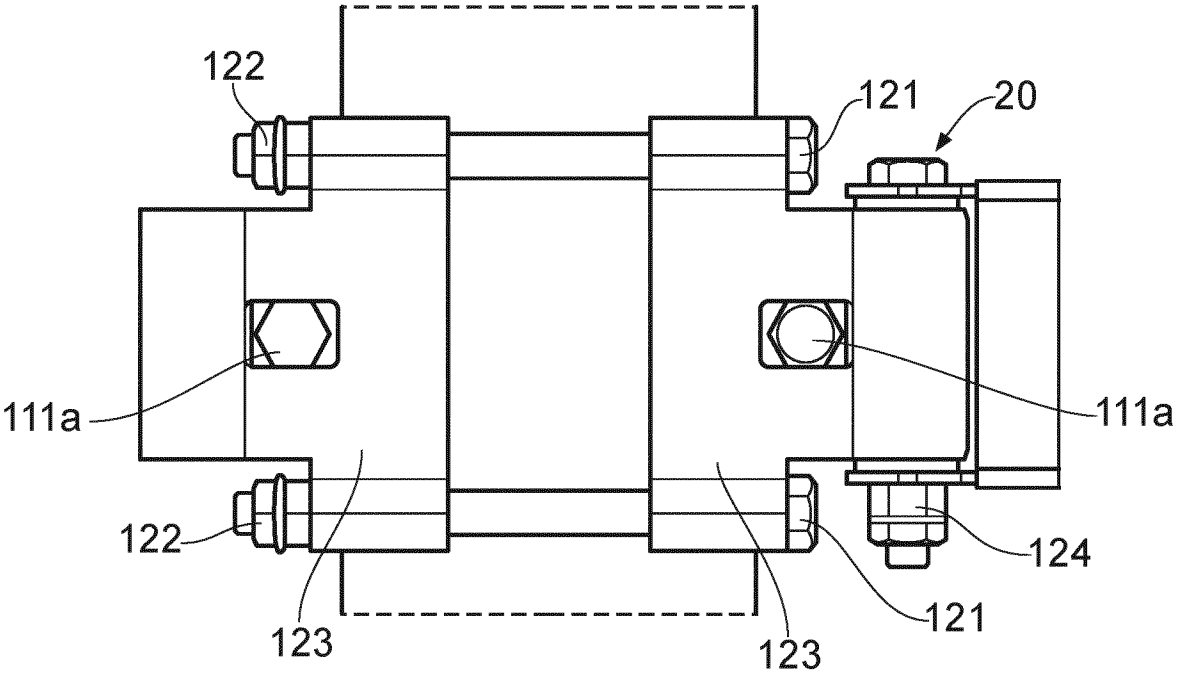
FIG. 3 is a schematic of an example of an underside view of a rail clamp.

In an example, as shown in FIG. 3, which shows the underside of the rail clamp 20, the rail clamp 20 may be adjustable in width. The width may be adjusted by appropriate tightening/untightening of through bolts 121 that pass under the rail 40. The bolts 121 may allow for adjustment over any desired range of rail foot widths. In some examples, the range may include 100 mm to 155 mm rail foot widths. The bolts 121 may be fastened by corresponding nuts 122, such as locking nuts.

The rail clamp 20 may clamp a rail 40 in place by positioning the rail foot between a clamp plate 112 and a clamp seat 123. The clamp plate 112 and clamp seat 123 may be held together by bolts 111, described in more detail below.

The rail clamp 20 may further be adjustable for different foot heights. As shown in FIG. 1, the rail clamp 20 may be adjusted by a convex 'arched' washer arrangement, in the concave 'arched' housing of the clamp seat. Therefore, various rail foot heights may be accommodated by the rail clamp.

In an example, the rail clamp 20 may comprise pivotally attachable fasteners to clamp a foot of the rail 40. The rail clamp 20 may include a portion arranged to extend at least partly over the foot of the rail, so that, when tightened, the portion holds or clamps onto the rail. In an example, the rail clamp connector 10 may be fixed in place by a fixing device 124 to restrict relative movement of the first part and the second part at the pivotal connection. The fixing device 124 may for example comprise a through bolt and locking nut.

Figure 4A:
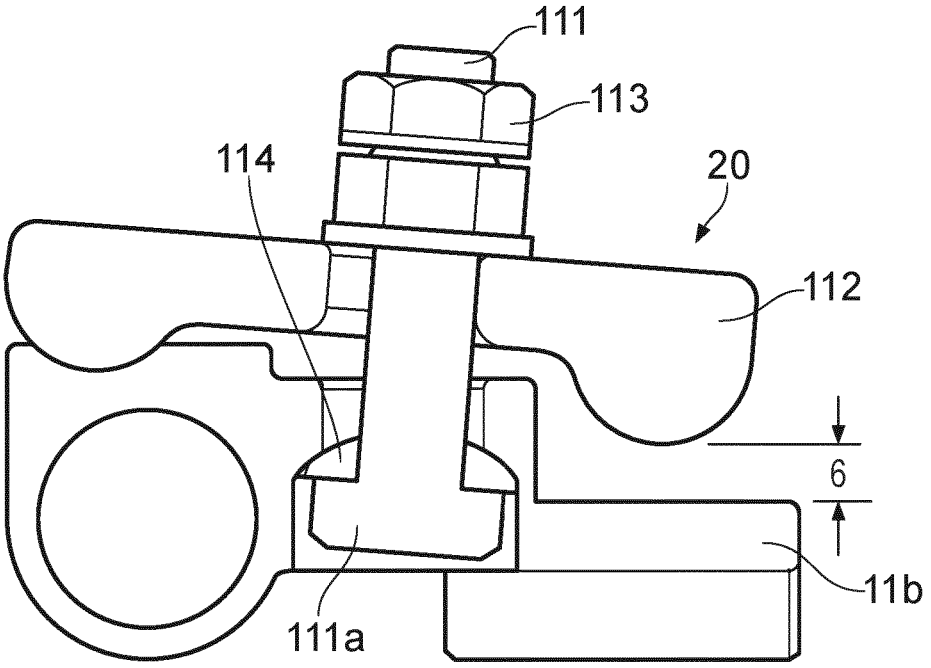
FIGS. 4*a* and 4*b* are schematics of an example of an adjustable clamp.
Figure 4B:
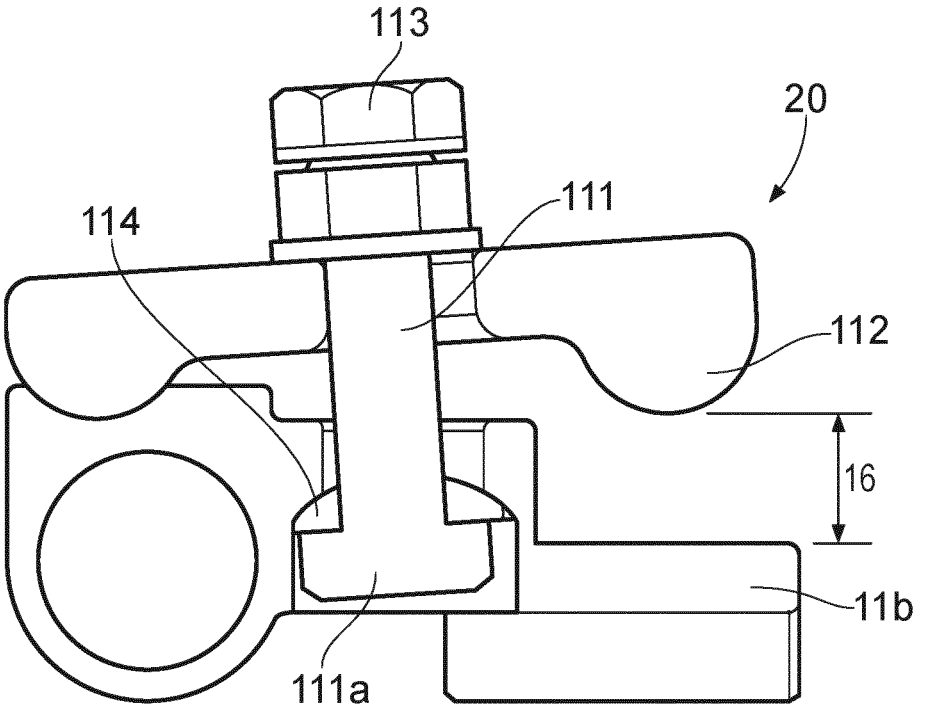

As shown in FIGS. 4*a* and 4*b*, in some examples the rail clamp 20 may provide a clamp or fastener which may attach to a rail 40 and the rail clamp connector 10. The rail clamp 20 may include a clamp bolt 111 which passes through the clamp seat 123, through the second part 11*b* of the rail clamp connector 10, through a clamp plate 112 and engages with a nut 113, such as a hardlock nut. The second part 11*b* of the rail clamp connector 10 defines an arched or concave housing for the bolt head 111*a*. Between the bolt head 111*a* and the concave housing of the second part 11*b* there is provided an arched or convex washer 114 which allows the bolt 111 to pivot relative to the second part 11*b* of the rail clamp connector 10. In another example, the bolt head 111*a* may be arched or convex, in a similar shape to the washer, so as to allow the bolt 111 to pivot relative to the second part 11*b* of the rail clamp connector 10. As shown in FIG. 4*a*, the bolt 111 may pivot slightly clockwise (as shown in the figure) to clamp onto a rail foot having a height of 6 mm and may pivot slightly anticlockwise, as shown in FIG. 4*b* to accommodate a rail foot having a greater height, so as 16 mm in the example shown. The values shown in the figures are exemplary and only used for explanation. The fasteners, such as nut and bolt-type fasteners, being able to pivot may ensure than the clamp is firmly securable around the foot of the rail by aligning the head of the bolt, and the nut, respectively, with the surfaces of the clamp seat and clamp plate.

Figure 5:
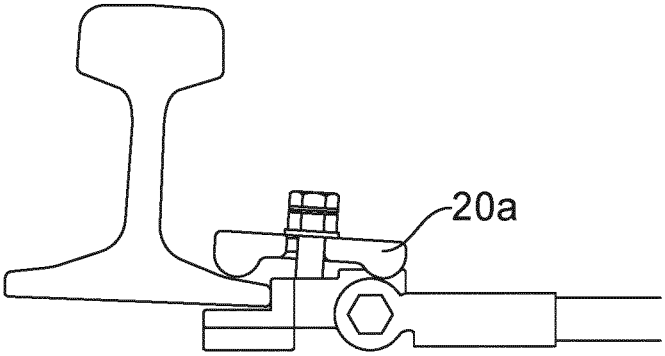
FIG. 5 is a schematic of an example of a rail clamp.

In an example, as shown in FIG. 5, a rail clamp 20*a* may clamp a rail 40 in place by positioning the rail foot between a clamp plate and a clamp seat, as shown in FIGS. 4*a* and 4*b*. In the example shown in FIG. 5, the rail clamp 20*a* only clamps to one side of the rail. For example, the rail clamp 20 may comprise two rail clamps 20*a*, connected together by one or more fasteners, which, in situ, may pass underneath the rail 40.

Figure 6:
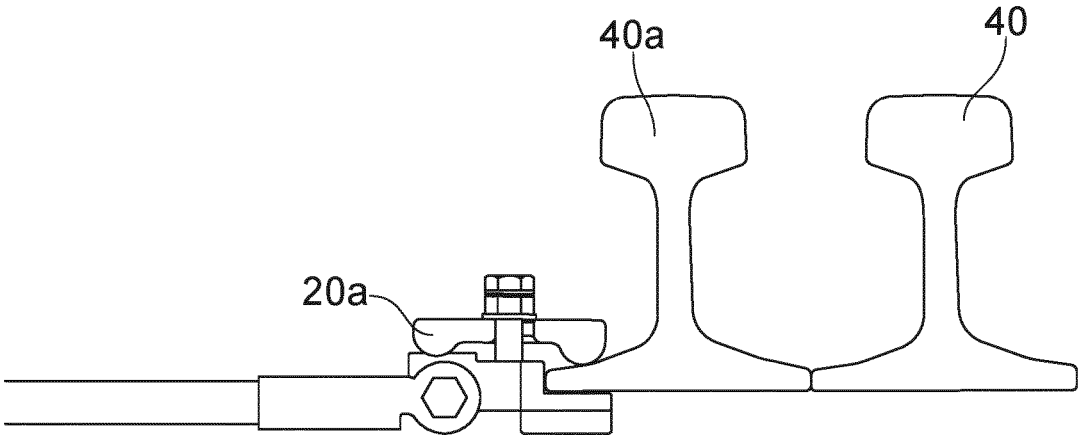
FIG. 6 is a schematic of an example of a rail clamp assembly attached to a guard rail.

In an example, as shown in FIG. 6, the rail clamp 20*a* may clamp to a guard rail 40*a*. The guard rail 40*a* may normally run next to the running rail 40, on the inside (between the two running rails 40). In this example, the beam 30 may be correspondingly shorter than if attached between the two running rails 40. The guard rail 40*a* may for example be oriented vertically, whereas the running rail 40 may lean. With the rail clamp connector 10 as described above in a rail clamp assembly 1, the assembly 1 may be mounted onto a running rail 40 which is leaning at one end and a guard rail 40*a*, which is vertical (the foot thus being horizontal), at the other end.

While the apparatus and related aspects have been described with reference to certain examples, various modifications, changes, omissions, and substitutions can be made without departing from the spirit of the present disclosure. It is intended, therefore, that the apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A rail clamp connector, for connecting a rail clamp to a beam, the rail clamp connector comprising:

a first part connectable to the beam;

a second part connectable to the rail clamp, the second part being pivotally connected to the first part by virtue of a pivotal connection such that the first and second parts rotate with respect to one another and that the first part is adjustable to compensate for leaning of a rail relative to the beam, the rail clamp being connectable to the rail when in use; and a vibration damping device at the pivotal connection to reduce the transmittal of vibration from the second part to the first part.

2. The rail clamp connector of claim 1, wherein the second part is pivotally connected to the first part by a clevis joint.

3. The rail clamp connector of claim 1, wherein the vibration damping device is a resiliently deformable member.

4. The rail clamp connector of claim 3, wherein the resiliently deformable member is made of rubber.

5. The rail clamp connector of claim 1, further comprising:

a fixing device to restrict relative movement of the first part and the second part at the pivotal connection.

6. A rail clamp assembly comprising:

the rail clamp connector of claim 1; and an adjustable rail clamp connectable to an underside of a rail.

7. The rail clamp assembly of claim 6, wherein the rail clamp is adjustable in width to be connectable around the underside of rails of differing widths.

8. The rail clamp assembly of claim 7, further comprising:

a beam connectable to the first part, wherein in use, the beam extends above the underside of the rail.

9. The rail clamp assembly of claim 6, wherein the rail clamp comprises pivotally attachable fasteners to clamp to a foot of the rail.

10. The rail clamp assembly of claim 6, further comprising:

a beam connectable to the first part, wherein in use, the beam extends above the underside of the rail.

11. A rail clamp assembly comprising:

the rail clamp connector of claim 1; and an adjustable rail clamp connectable to a side of a foot of a rail, wherein the rail is a running rail or a guard rail.

12. A rail clamp assembly comprising:

a beam;

a first rail clamp connector of claim 1 attached to one end of the beam;

a second rail clamp connector of claim 1 attached to the other end of the beam;

a first adjustable rail clamp connected at one side to the first rail clamp connector and at the other side to a side of a foot of a first rail; and a second adjustable rail clamp connected at one side to the second rail clamp connector and at the other side to a side of a foot of a second rail.

* * * * *